United States Patent [19]
Papalos et al.
[11] Patent Number: 4,457,762
[45] Date of Patent: Jul. 3, 1984

[54] STABILIZED WATER SLURRIES OF CARBONACEOUS MATERIALS

[75] Inventors: John G. Papalos, Ledgewood; Josè L. Villa, Bridgewater, both of N.J.; Kathy A. Knitter, Newark, Calif.; Arpal Savoly, Martinsville, N.J.

[73] Assignee: Diamond Shamrock Chemicals Company, Dallas, Tex.

[21] Appl. No.: 456,394

[22] Filed: Jan. 7, 1983

[51] Int. Cl.[3] ..... C10L 1/32
[52] U.S. Cl. ..... 44/51; 44/76; 260/512 C; 252/353
[58] Field of Search ..... 44/51, 76; 252/353; 260/512 R, 512 C

[56] References Cited

U.S. PATENT DOCUMENTS

| | | | |
|---|---|---|---|
| 4,282,006 | 8/1981 | Funk | 44/51 |
| 4,322,372 | 3/1982 | Wurmli et al. | 260/512 R |
| 4,325,890 | 4/1982 | Reitz | 260/512 C |
| 4,330,301 | 5/1982 | Yamamura et al. | 44/51 |

FOREIGN PATENT DOCUMENTS

| | | | |
|---|---|---|---|
| 57-92090 | 6/1982 | Japan | 44/51 |

*Primary Examiner*—Charles F. Warren
*Assistant Examiner*—Margaret B. Medley
*Attorney, Agent, or Firm*—Leslie G. Nunn, Jr.

[57] ABSTRACT

Improved stabilized water slurries of carbonaceous materials are obtained by having present a condensation product or a salt thereof of a substituted phenol sulfonic acid which is (a) an arylphenol sulfonic acid,
(b) an aralkylphenol sulfonic acid,
(c) an arylphenol sulfonic acid and arylsulfonic acid mixture, or
(d) an aralkylphenol sulfonic acid and arylsulfonic acid mixture, condensed with from about 0.5 to about 4.0 moles of formaldehyde per mole of sulfonic acid with the proviso that the weight ratio if substituted phenol sulfonic acid to arylsulfonic acid is from about 0.95:0.05 to about 0.05:0.95 in the mixtures, the condensation product being present in an amount sufficient to reduce viscosity of the water slurry of carbonaceous materials, to stabilize carbonaceous materials in the water network and to improve its pumpability. If desired, an acid form or a salt of the condensation product may be used.

16 Claims, No Drawings

STABILIZED WATER SLURRIES OF CARBONACEOUS MATERIALS

BACKGROUND OF THE INVENTION

1. Field of the Invention

This invention relates to stabilized water slurries of carbonaceous materials and more particularly to coal water slurries stabilized with condensates of substituted phenol sulfonic acid and formaldehyde.

2. Description of the Prior Art

Transport is one of the major problems involved in use of particulate carbonaceous materials such as coal. One method of transport involves aqueous slurries. However, aqueous slurries of finely ground coal containing over 55 weight percent solids are difficult to pump with slurry pumps. This is because as the solids level is increased above 50 weight percent, water and solids tend to separate causing build-up of coal particles in parts of the pumping system. Dewatering of the slurry causes blockage and jamming in the pumping system.

On the other hand, decreasing the weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, the efficiency of the coal burning process increases. Hence, use of higher weight percent solids aqueous carbonaceous slurries than were heretofore feasible are of great importance.

U.S. Pat. No. 4,282,006—Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For dispersing agents, see column 29, line 53 to column 31, line 9, including condensed mononaphthalene sulfonic acid and its sodium and ammonium salts (column 30, lines 19 and 20).

U.S. Pat. No. 4,330,301—Yamamura et al, May 18, 1982, describes dispersants for aqueous coal slurries including sodium and ammonium salts of condensation products of naphthalene sulfonic acid and formaldehyde condensates. See column 2, lines 41 to 43 and columns 5 and 6.

SUMMARY OF THE INVENTION

Improved stabilized water slurries of solid particulate carbonaceous materials having reduced viscosity, a stabilized network of carbonaceous materials in water and improved pumpability are obtained by having present a condensation product and salts thereof of a condensate of a substituted phenol sulfonic acid which is (a) an arylphenol sulfonic acid, (b) an aralkylphenol sulfonic acid, (c) an arylphenol sulfonic acid and arylsulfonic acid mixture, or (d) an aralkylphenol sulfonic acid and arylsulfonic acid mixture, condensed with from about 0.5 to about 4.0 moles of formaldehyde per mole of sulfonic acid with the proviso that the weight ratio of substituted phenol sulfonic acid to arylsulfonic acid is from about 0.95:0.05 to about 0.05:0.95 in the mixtures, the condensation product being present in an amount sufficient to reduce viscosity of the water slurry of carbonaceous materials to stabilize carbonaceous materials in the water network and to improve its pumpability. If desired, an acid form or salt of the condensation product may be used.

DETAILED DESCRIPTION

The condensation product of a substituted phenol sulfonic acid and formaldehyde, hereinafter referred to as condensation product for convenience, is present in the water slurry of carbonaceous materials in amounts sufficient to reduce viscosity of the slurry and improve its pumpability. Concentration of the condensation product added, based on the total weight of the carbonaceous materials water slurry, can be up to 10% by weight, preferably from about 0.01% by weight to about 5.0% by weight. For example, from about 0.05% by weight to about 0.5% by weight of the condensation product, based on the total weight of the slurry, i.e., solids plus water, can be used. Amount of the condensation product required is easily determined by introducing the condensation product in an amount sufficient to form a soft sediment. The resulting slurries will generally have from about 50% to about 80% by weight or higher solids with the balance being water. The coal water slurries are also known as coal-water mixtures (CWM).

The term "carbonaceous materials", as used herein, encompasses solid particulate carbonaceous fossil fuel materials which may have been powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in carbonaceous materials slurries may be taken from any available source such as mine, well, river, or lake water or desalinated ocean water having a sufficiently low mineral salt content such that the electrochemistry of the bound water layer and carrier water interface can be controlled so that corrosion of milling facilities, pipelines and furnaces will be minimized or inhibited.

Useful condensates or condensation products of substituted phenol sulfonic acid and formaldehyde may be derived from arylphenols and aralkylphenols having the formula

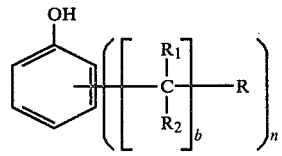

wherein R is an aryl radical such as phenyl, diphenyl, naphthyl, hydroxymethylphenyl or the like; $R_1$ is hydrogen or an alkyl radical having from about 1 to about 5 carbon atoms such as methyl, ethyl, propyl, butyl, amyl or the like; $R_2$ is hydrogen or an alkyl radical having from about 1 to about 5 carbon atoms such as methyl, ethyl, propyl, butyl, amyl or the like, n is from about 1 to about 3 and b is 0 or 1. Condensation products of mixtures of substituted phenol sulfonic acid and arlylsulfonic acid with formaldehyde may also be used. These condensation products and their preparation are described in copending patent application Ser. No. 396,698—Papalos and Savoly, filed July 9, 1982. The condensation products shown in Table I are from Examples 1–59 of Ser. No. 396,698.

Arylsulfonic acids which may be used in the condensates include sulfonic acids of aryl hydrocarbons such as benzene, naphthalene, toluene, xylene, biphenyl, diphenyl ether, alkylated naphthalene and alkylated biphenyl having from 1 to 5 carbon atom alkyl groups.

Condensation products may be used directly in their free acid forms or as salts obtained by neutralization with salt forming cations such as alkalis, alkaline earths, ammonia and organic amines. Useful cations include potassium, sodium, lithium, ammonium, aluminum, barium, calcium, magnesium and like cations. Cations derived from organic amines such as methylamine, ethanolamine, diethylamine, isopropylamine and the like may also be used.

Table I gives details on condensation products selected from examples in U.S. Ser. No. 396,698. This table shows the number of the example (Example No.), identifies the substituted phenol or mixture of substituted phenol and hydrocarbon (RH) sulfonated, the ($H_2SO_4$/RH Molar Ratio) used in the sulfonation, the ($CH_2O/RSO_3H$ Molar Ratio) used in the condensation and the (Salt Forming Cation) used to neutralize the condensation product. The Key to Table I provides the code for each substituted phenol or hydrocarbon used in the examples.

TABLE I

Condensation Products of Substituted Phenol Sulfonic Acid and Formaldehyde From Serial No. 396,698 - Example Nos. 1–59

| Example No. | RH | $H_2SO_4$/RH Molar Ratio | $CH_2O/RSO_3H$ Molar Ratio | Salt Forming Cation |
|---|---|---|---|---|
| 1 | MSP | 3.00 | 0.6 | $NH_4$ |
| 43 | MSP | 3.00 | 1.6 | Mg |
| 47 | MSP | 3.33 | 1.6 | K |
| 48 | DSP | 3.33 | 1.6 | K |
| 49 | DSP | 6.00 | 2.0 | K |
| | TSP | | | |
| 52 | IDP | 3.33 | 1.0 | K |
| 55 | PP | 3.33 | 1.1 | K |
| 58 | PP | 3.33 | 1.2 | K |
| | X | 1.50 | | |
| 59 | DSP | 4.50 | 1.2 | K |
| | X | 1.50 | | |

Key to Table I
RH substituted phenol or hydrocarbon
$RSO_3H$ substituted phenol sulfonic acid
MSP monostyrenated phenol
DSP distyrenated phenol
TSP tristyrenated phenol
PP phenylphenol
IDP isopropylidenediphenol
X xylene The following procedure may be used in evaluation of the condensation products in aqueous coal slurries. This procedure determines ability of the condensation products to disperse or suspend coal dust uniformly in water by measuring viscosity and examining the sediment, if formed.

Apparatus Used 8-oz. paint can
Low shear mechanical mixer with a double blade
Spatula
Stormer viscometer Reagents Used Water of known record hardness
Coal dust—Reference coal is Pittston Coal, 80% through 200 mesh (U.S. Series). Other types of coal and grind sizes can be substituted.
Stabilizing agent Procedure 1. A slurry of coal dust in water is prepared as follows. Coal dust is slowly added to water under agitation by a low shear mechanical mixer with a double blade. (Do not use a "Lightnin" high speed mixer). Sides of the container are scraped regularly while mixing. The slurry is agitated for an additional hour to ensure uniformity.
2. Into 200 gram samples of the slurries weighed out into 8 oz. paint cans, specific quantities of the water soluble polymer are weighed out, the cans closed tightly to prevent evaporation of water, allowed to sit overnight and then checked for sediment firmness with 3/16" glass rod. Subsequently, the condensation product is added and the viscosity determined according to 3 below. The sediment firmness is rechecked after 72 hours or 168 hours.
3. Viscosity of the aqueous coal slurry is determined using 200 gram samples of the slurry in 8 oz. paint cans. Each slurry is stirred with a spatula before viscosity measurements are made with a Stormer Viscometer. Weights are adjusted in order to find a reading as close as possible to 30 seconds and the correct weight for a 30-second viscosity is determined. Readings are repeated twice after stirring each time and should not differ by more than 2 seconds. Readings are repeated until consistent and the average of two readings taken.
4. Seconds and weight are converted into krebs units which are then converted to centipoise readings. All percents by weight shown in the results are percents by weight based upon the total weight of the slurry.

For a fuller understanding of the nature and advantages of this invention, reference may be made to the following examples. These examples are given merely to illustrate the invention and are not to be construed in a limiting sense. All quantities, proportions and percentages are by weight and all references to temperature are °C., unless otherwise indicated.

EXAMPLE I

Samples of coal water slurries were treated with the quantities of condensation products of substituted phenol sulfonic acid and formaldehyde as dispersant shown in Table II using 60/40 by weight tap water slurries of powdered Falcon and Pittston coals. Condensation products from Example Nos. 1, 43, 47, 48, 55 and 58 described in Table I above were evaluated as dispersants at 0.1, 0.2, 0.3 or 0.5% by weight, based on the total weight of the water slurries of powdered coal. Samples of water slurries of the two powdered coals without dispersants were used as blanks. Samples of the water slurry blanks (no dispersant) and of the treated water slurries were evaluated by the evaluation procedure described above to obtain the results in Table II.

TABLE II

| Condensation Product of Example No. | Source of Coal | Slurry Viscosity (cps) at Indicated % by Wt. of Dispersant 0.1 | 0.2 | 0.3 | 0.5 |
|---|---|---|---|---|---|
| 1 | Falcon | 1240 | 1240 | 1240 | — |
| 43 | Falcon | 1600 | 1110 | 830 | — |
| 47 | Pittston | 720 | — | 430 | 380 |
| 55 | Pittston | 730 | 450 | — | 170 |
| 58 | Pittston | 1000 | 420 | — | 170 |

Viscosities for water slurries of samples of blanks (no dispersant) were >23,000 cps for a 60/40 Falcon coal water slurry and 3,000 cps for a 60/40 Pittston coal water slurry.

EXAMPLE II

Samples of 60/40 Pittston coal water slurries were treated with the condensation product of Example 55 and variations of the condensation product of Example 55 using the $H_2SO_4$/RH Molar Ratios and $CH_2O$/R-$SO_3H$ Molar Ratios for condensation products designated in Table III as A through E. Slurry samples were treated with 0.1, 0.2 amd 0.5% by weight of the condensation products as dispersants and were evaluated by the procedure described above to obtain the results in Table III. Viscosity of a sample of 60/40 Pittston coal water slurry (no dispersant) as a blank was 2600 cps.

TABLE III

| Condensation Product of Example No. | $H_2SO_4$/RH Molar Ratio | $CH_2O$/$RSO_3H$ Molar Ratio | Slurry Viscosity (cps) at Indicated % Wt. of Dispersant 0.1 | 0.2 | 0.5 |
|---|---|---|---|---|---|
| 55 | 3.33 | 1.1 | 520 | 450 | 170 |
| A | 3.33 | 1.6 | 760 | 450 | 170 |
| B | 3.33 | 2.0 | 900 | 460 | 170 |
| C | 2.50 | 1.2 | 500 | 600 | 170 |
| D | 2.50 | 0.8 | 960 | 360 | 170 |
| E | 4.50 | 1.1 | 920 | 430 | 170 |

EXAMPLE III

Samples of 60/40 Pittston coal water slurries were treated with condensation product of Example 59 and variations of the condensation product of Example 59 using the molar ratios for the monostyrenated phenol sulfonic acid (MSPSA), xylene sulfonic acid (XSA) and formaldehyde ($CH_2O$) for the condensation products designated in Table IV as A through E. Slurry samples were treated with 0.1, 0.2 and 0.5% by weight of the condensation products as dispersants and were evaluated by the procedure described above to obtain the results in Table IV. Viscosity of a sample 60/40 Pittston coal water slurry (no dispersant) as a blank was 3000 cps.

TABLE IV

| Condensation Product of Example No. | MSPSA:XSA:$CH_2O$ Molar Ratio | Slurry Viscosity (cps) at Indicated % Wt. of Dispersant 0.1 | 0.2 | 0.5 |
|---|---|---|---|---|
| 59 | 2:1:1.6 | 990 | 600 | 240 |
| A | 1:1:1.6 | 1200 | 800 | 310 |
| B | 2:1:1.2 | 990 | 490 | 230 |
| C | 1:1:1.2 | 1200 | 600 | 250 |
| D | 2:1:1.0 | 1050 | 600 | 240 |
| E | 1:1:1.0 | 1190 | 250 | 230 |

EXAMPLE IV

Samples of 60/40 Pittston coal water slurries were treated with 0.1 to 0.3% by weight of condensation products of Examples 55 and 58 as a stabilizer or dispersant and with or without 0.05% by weight based on total slurry weight of Karaya gum as a costabilizer. The samples were evaluated initially and after ten days using the procedure described above to obtain the results in Table V.

TABLE V

| Condensation Product of Example Number | % Concentration of Condensation Product % By Wt. | Initial % Sediment | Initial Slurry Viscosity (cps) | After 10 Days % Sediment | After 10 Days Slurry Viscosity (cps) |
|---|---|---|---|---|---|
| | With 0.05% Karaya gum as costabilizer:) | | | | |
| 55 | 0.1 | 0 | 330 | 4.2 | 250 |
| 58 | 0.1 | 0 | 330 | 3.8 | 435 |
| 58 | 0.3 | 0 | 210 | 3.8 | 250 |
| | (Without 0.05% Karaya gum as costabilizer:) | | | | |
| 55 | 0.1 | 0 | 667 | 2.0 | 975 |
| 58 | 0.1 | 0 | 360 | 9.5 | 2375 |
| 58 | 0.3 | 0 | 1000 | 3.9 | 410 |

EXAMPLE V

A. Sulfonation of methyl biphenyl

To a 1 liter, 4 neck flask, equipped with stirrer, thermometer, dropping funnel and reflux condenser, there was charged 168 grams methyl bisphenyl (1 mole). To this was added dropwise, with stirring, 300 grams fuming $H_2SO_4$ (20% $SO_3$). The temperature rose to 70° C. The temperature was maintained at 70°–80° C. by adjusting the rate of addition of the fuming $H_2SO_4$. This temperature was maintained after the addition of the fuming $H_2SO_4$ was completed for 5 hours. It was then diluted with 250 grams of water, which was added slowly, with cooling.

B. Condensation of sulfonated methyl biphenyl and sulfonated distyrenated phenol with formaldehyde In a reaction similar to that described in Eample V A, were charged 36 grams of (0.05) mole sulfonated methyl biphenyl, 179 grams (0.15 mole) sulfonated distyrenated phenol and 19.5 grams (0.24 mole) of 37% formaldehyde solution. The mixture was heated at reflux for 24 hours, 231 grams of the condensate was then neutralized with 85.8 grams of 27% aqueous ammonia solution to a pH of 7.0 to obtain the ammonium salt of the condensation product.

EXAMPLE VI

A. Sulfonation of diphenyl ether

To a reactor similar to that described in Example V A were charged 170 grams (1 mole) of diphenyl ether. To this were then added dropwise, with stirring, 300 grams fuming sulfuric acid (20% $SO_3$), beginning at ambient temperature. When the temperature reached 50° C., the rate of addition was slowed in order to maintain 50°-55° C. After addition was complete, the mixture was stirred at 50°-55° C. for one hour longer. The temperature was then raised to 80° C. and maintained for 3 hours. Then 261 grams of water was added to dilute the product in preparation for condensation.

B. Condensation of sulfonated diphenyl ether, sulfonated distyrenated phenol and formaldehyde To a flask similar to the one described in Example V A, were added 73 grams (0.1 mole) sulfonated diphenyl ether, 120 grams (0.1 mole) sulfonated distyrenated phenol and 19.5 grams (0.24 mole) of 37% formaldehyde solution. This mixture was heated to reflux and maintained at reflux for 30 hours. 223 grams of the condensate was neutralized with 86 grams 27% aqueous ammonia solution to obtain the ammonium salt of the condensation product.

EXAMPLE VII

A. Sulfonation of a blend of diphenyl and distyrenated phenol

To a reactor similar to the one described in Example V A were added 78 grams (0.5 mole) diphenyl, 151 grams (0.5 mole) distyrenated phenol. This was warmed to 50° C. to melt. To this melt was then added 370 grams fuming sulfuric acid (20% $SO_3$). Slowly, allowing the temperature to rise to 60°-65° C. and continuing the addition in this temperature range, the mixture was then heated to 95° C. and kept at this temperature for 2 hours. 603 grams were diluted with 350 grams water.

B. Condensation of mixture of sulfonated diphenyl and sulfonated distyrenated phenol with formaldehyde To a reactor similar to the one described in Example V A, were added 476 grams of the mixed sulfonates described in Example VII A. This contained 0.25 mole each of sulfonated diphenyl and sulfonated distyrenated phenol. To this were added 49 grams (0.6 mole) 37% formaldehyde. This mixture was heated at reflux for 26 hours. The mixture was neutralized to a pH of 7.0-7.5 by addition of 179 grams 27% aqueous ammonia solution to obtain the ammonium salt of the condensation product.

EXAMPLE VIII

Samples of 60/40 Pittston coal water slurries were treated with the condensation products from Examples V, VI and VII. Slurry samples were treated with 0.1, 0.2, 0.5 and 0.75% by weight of the condensates as dispersants and were evaluated by the procedure described above to obtain the results in Table VI. Viscosity of a sample of 60/40 Pittston coal water slurry (no dispersant) as a blank was 3188 cps.

TABLE VI

| Condensation Product of Example No. | $H_2SO_4$/RH Molar Ratio | $CH_2O$/$RSO_3H$ Molar Ratio | Slurry Viscosity (cps) at Indicated % Wt. of Dispersant 0.1 | 0.2 | 0.5 | 0.75 |
|---|---|---|---|---|---|---|
| V B | 3.0 | 1.2 | 925 | 480 | 330 | 330 |
| VII B | 3.0 | 0.7 | 900 | 480 | 330 | 330 |
| VI B | 3.0 | 2.4 | 925 | 480 | 385 | 330 |
| | Hydrocarbon Description | | | | | |
| V B | Methyl biphenyl/distyrenated phenol | | | | | |
| VII B | Biphenyl/distyrenated phenol | | | | | |
| VI B | Diphenyl ether/distyrenated phenol | | | | | |

While the invention has been described with reference to certain specific embodiments thereof, it is understood that it is not to be so limited since alterations and changes may be made therein which are within the full intended scope of the appended claims.

What is claimed is:

1. A water slurry of solid particulate carbonaceous materials having present a condensation product and salts thereof of a condensate of a substituted phenol sulfonic acid selected from the group consisting of (a) an arylphenol sulfonic acid, (b) an aralkylphenol sulfonic acid, (c) an arylphenol sulfonic acid and arylsulfonic acid mixture, and (d) an aralkylphenol sulfonic acid and arylsulfonic acid mixture, condensed with from about 0.5 to about 4.0 moles of formaldehyde per mole of sulfonic acid with the proviso that the weight ratio of substituted phenol sulfonic acid to arylsulfonic acid is from about 0.95:0.05 to about 0.05:0.95 in the mixtures, the condensation product being present in an amount sufficient to reduce viscosity of the water slurry to stabilize carbonaceous materials in water network and to improve pumpability of the water slurry.

2. The slurry of claim 1 wherein from about 1 to about 8 sulfonic acid groups are present in the substituted phenol sulfonic acid in the condensation product.

3. The slurry of claim 1 wherein the condensation product has a substituted phenol of formula

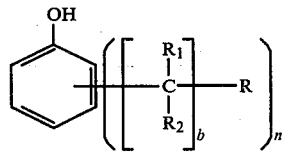

where

R is an aryl radical, $R_1$ is hydrogen or an alkyl radical having from about 1 to about 5 carbon atoms, $R_2$ is hydrogen or an alkyl radical having from about 1 to about 5 carbon atoms, n is from 1 to 3, and b is from 0 to 1.

4. The slurry of claim 1 wherein the salt forming cation present in the condensation product is selected from the group consisting of sodium, potassium, lithium, ammonium, zinc, calcium, barium, magnesium, aluminum, methylamine, monoethanolamine, diethanolamine, triethanolamine and isopropanolamine.

5. The slurry of claim 1 wherein the aralkylphenol sulfonic acid in the condensation product is monobenzylphenol sulfonic acid.

6. The slurry of claim 1 wherein the aralkylphenol sulfonic acid in the condensation product is dibenzylphenol sulfonic acid.

7. The slurry of claim 1 wherein the aralkylphenol sulfonic acid in the condensation product is tribenzylphenol sulfonic acid.

8. The slurry of claim 1 wherein the aralkylphenol sulfonic acid in the condensation product is isopropylidene-diphenol sulfonic acid.

9. The slurry of claim 1 wherein the aryl phenol sulfonic acid in the condensation product is phenylphenol sulfonic acid.

10. The slurry of claim 1 wherein the aryl sulfonic acid in the condensation product is naphthalene sulfonic acid.

11. The slurry of claim 1 wherein the aryl sulfonic acid in the condensation product is xylene sulfonic acid.

12. The slurry of claim 1 wherein the condensation product is the potassium salt of the condensation product of one mole of aralkylphenol sulfonated with 3 moles of sulfonating agent to obtain aralkylphenol sulfonic acid and then one mole of the aralkylphenol sulfonic acid condensed with 1.8 moles of formaldehyde.

13. The slurry of claim 1 wherein the condensation product is the sodium salt of the condensation product of one mole of aralkylphenol sulfonated with 3 moles of sulfonating agent to obtain aralkylphenol sulfonic acid and then one mole of the aralkylphenol sulfonic acid condensed with 1.4 moles of formaldehyde.

14. The slurry of claim 1 wherein the condensation product is one mole of aralkylphenol sulfonated with 3 moles of sulfonating agent to obtain aralkylphenol sulfonic acid and then one mole of the aralkylphenol sulfonic acid condensed with 1.2 moles of formaldehyde.

15. The slurry of claim 1 wherein the arylsulfonic acid is diphenyl ether sulfonic acid.

16. The slurry of claim 1 wherein the arylsulfonic acid is diphenyl sulfonic acid.

* * * * *